United States Patent [19]

Mukunoki et al.

[11] 4,080,209

[45] Mar. 21, 1978

[54] PHOTOGRAPHIC LIGHT-SENSITIVE MATERIAL

[75] Inventors: Yasuo Mukunoki; Takeshi Mikami; Nobuo Tsuji, all of Minami-ashigara, Japan

[73] Assignee: Fuji Photo Film Co., Ltd., Minami-ashigara, Japan

[21] Appl. No.: 702,322

[22] Filed: Jul. 2, 1976

[30] Foreign Application Priority Data

Jul. 13, 1975 Japan ..... 50-82078

[51] Int. Cl.[2] ..... G03C 1/48; G03C 1/02

[52] U.S. Cl. ..... 96/76 R; 96/56; 96/82; 96/84 UV; 96/94 R; 96/95; 96/100 R

[58] Field of Search ..... 96/97, 100, 84 UV, 94 R, 96/56, 95

[56] References Cited

U.S. PATENT DOCUMENTS

| | | | |
|---|---|---|---|
| 2,322,027 | 6/1943 | Jelley et al. | 96/97 |
| 2,640,776 | 6/1953 | Spence et al. | 96/100 |
| 3,912,517 | 10/1975 | Van Poucke et al. | 96/100 |

*Primary Examiner*—J. Travis Brown

*Attorney, Agent, or Firm*—Sughrue, Rothwell, Mion, Zinn and Macpeak

[57] ABSTRACT

A silver halide photographic light-sensitive material comprising a hydrophilic organic colloid layer containing a photographic additive dispersed therein using as a solvent a benzoic acid ester which has a boiing point of greater than 250° C at atmospheric pressure, which is soluble in water in a proportion of less than about 10% by weight, and which dissolves water in a proportion of less than about 5% by weight. The benzoic acid ester does not have any harmful influence on the human body and does not cause environmental pollution.

17 Claims, No Drawings

PHOTOGRAPHIC LIGHT-SENSITIVE MATERIAL

BACKGROUND OF THE INVENTION

1. Field of the Invention

The present invention relates to a photographic light-sensitive material containing an organic material which does not cause environmental pollution during production or processing of the photographic light-sensitive material or when the photographic material is discarded after processing. More particularly, the present invention relates to a photographic light-sensitive material containing a photographic additive dispersed using a specific benzoic ester.

2. Description of the Prior Art

Conventionally, a photographic additive, for example, an oil-soluble coupler, a color stain preventing agent or an antioxidant (such as an alkylhydroquinone, an alkylphenol, a chroman, a cumarone, etc.), a hardening agent, an oil-soluble filter dye, an oil-soluble ultraviolet absorbing agent, a DIR compound (such as a DIR hydroquinone, a non-color forming DIR compound, etc.), a developing agent, a dye developing agent, a DDR redox compound, a DDR coupler, and the like is dissolved in an appropriate organic solvent having a high boiling point, dispersed in an aqueous solution of a hydrophilic organic colloid, particularly gelatin, in the presence of a surface active agent, and the resulting mixture is incorporated in a hydrophilic organic colloid layer, for example, a light-sensitive emulsion layer, a filter layer, a backing layer, an antihalation layer, an intermediate layer, a protective layer, and the like. Since such photographic additives are water-insoluble and hydrophobic, they cannot be incorporated into a hydrophilic organic colloid layer without the aid of organic solvent. In such a case, a phthalic acid ester and a phosphoric acid ester are particularly useful as the high boiling point organic solvent.

Nowadays, these types of solvents are used in producing most color photographic high-sensitive materials as solvents for an oil-soluble incorporated type coupler. These solvents are described, for example, in U.S. Pat. Nos. 2,332,027; 2,533,514 and 3,287,134, German Pat. No. 1,152,610 and British Pat. No. 1,272,561, etc. The high boiling point organic solvents of the phthalic acid ester and the phosphoric acid ester type are considered to be the most excellent compounds of the known high boiling point organic solvents with respect to dispersion capability for couplers, affinity to a gelatin colloid layer, influence on the stability of a color image formed, influence on the hue of a color image formed, chemical stability in a photographic light-sensitive materials, low price, and the like.

In the incorporated type color photographic light-sensitive material, an antioxidant is used alone or in combination with a coupler or other additives for the purpose of preventing color mixing due to diffusion of an oxidation product of a color developing agent, improving image quality by using a DIR-hydroquinone, preventing the formation of fog during color development, preventing the formation of stain, improving the stability of the color image formed, and the like. Most of these antioxidants are dispersed in a hydrophilic colloid using a phthalic acid ester or a phosphoric acid ester as a solvent. These solvents which can be used for dispersing the antioxidant also have excellent properties, for example, good dispersion capability for an antioxidant, they promote the reaction of an oxidation product of a color developing agent with an antioxidant, improve chemical stability of the antioxidant per se during storage, and the like.

In the incorporated type color photographic light-sensitive material and the black and white photographic light-sensitive material, a filter dye absorbing a specific region of visible light, an ultraviolet absorbing agent and a fluorescent brightning agent are incorporated for the purpose of improving color reproduction, improving image sharpness, and stabilizing the color image formed. For the filter dye, the ultraviolet absorbing agent and the fluorescent brightening agent, a phthalic acid ester and a phosphoric acid ester are often used as solvents.

Phthalic acid esters and phosphoric acid esters do not have any harmful effects on the body even in contact therewith or cause environmental pollution if they are contained in a photographic light-sensitive material. However, there is the danger that they can cause environmental pollution during the production and processing of the photographic light-sensitive material or when the photographic material is discarded after processing.

Also, an N-dialkyl substituted alkylamide compound as described in Japanese Patent Publication No. 21766/1968 can be used as a solvent for dispersing a filter dye in a hydrophilic colloid, but it has the drawback that a noxious residual odor remains.

Further, it is also known that a biphenyl derivative can be used as a high boiling point organic solvent as described, for example, in Japanese Patent Application (Laid Open) No. 14322/1973. However, the biphenyl derivative cannot be employed as it causes environmental pollution.

SUMMARY OF THE INVENTION

The object of the present invention is to remove the above-described drawbacks.

More particularly, an object of the present invention is to provide a photographic light-sensitive material which can be produced free of materials having a harmful effect on the human body.

Another object of the present invention is to provide a photographic light-sensitive material containing a photographic additive dispersed therein using a high boiling point solvent which does not have any harmful effect on the human body and which does not cause environmental pollution when discarded.

A further object of the present invention is to provide a photographic light-sensitive material which is advantageous in reducing environmental pollution in the processing steps for obtaining a photograph.

A still further object of the present invention is to provide a photographic light-sensitive material wherein a high boiling point organic solvent is used which provides excellent color image stability as compared to a phthalic acid ester or a phosphoric acid ester, as well as achieving the above described objects.

Other objects will be apparent from the following description of the invention.

These objects of the present invention are attained by dispersing a photographic additive in a hydrophilic organic colloid using a benzoic acid ester which has a boiling point greater than 250° C at atmospheric pressure, which is soluble in water in a proportion of less than about 10% by weight, which has a melting point not more than 100° C and which dissolves water in a proportion of less than about 5% by weight.

DETAILED DESCRIPTION OF THE INVENTION

The benzoic acid ester used in the present invention is characterized in that it fulfills all of the following requirements (1) to (3):

(1) Its boiling point is higher than 250° C atmospheric pressure (a pressure of one atmosphere), and it's melting point is not more than 100° C;

(2) Its solubility in water (at 25° C) is less than about 10% by weight; and (3) Its water dissolving capacity (at 25° C) is less than about 5% by weight.

The benzoic acid ester preferably used in practising the present invention is selected from compounds represented by the following general formula (I):

General Formula (I)

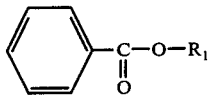

wherein $R_1$ represents an aliphatic hydrocarbon group of 24 or less carbon atoms, for example, an alkyl group having 8 to 24 carbon atoms such as octyl, decyl, lauryl, myristyl, cetyl, etc., an alkenyl group such as oleyl, etc., or a substituted alkyl group such as an alkoxyalkyl group having 4 to 24 carbon atoms (e.g., ethoxyethyl, butoxyethyl, etc.), a haloalkyl group having 4 to 24 carbon atoms (e.g., fluorinated heptyl, 5-chloropentyl, etc.), a perfluoroalkyl group having 4 to 24 carbon atoms (e.g., perfluoroheptyl, etc.), or a lactic acid ester residue represented by the formula $$=\underset{\underset{CH_3}{|}}{CH}-COOR_2$$

wherein $R_2$ represents an aliphatic hydrocarbon group of 24 or less carbon atoms, as described above, for example, an alkyl group having 3 to 24 carbon atoms (e.g., propyl, butyl, amyl, hexyl, octyl, decyl, lauryl, myristyl, cetyl, etc.), an alkenyl group, a substituted alkyl group such as an alkyloxyalkyl group, haloalkyl group, a perfluoroalkyl group, etc. Preferably, $R_1$ represents an alkyl group having 8 to 12 carbon atoms or a lactic acid ester residue wherein $R_2$ represents an aliphatic hydrocarbon group of 3 to 24 carbon atoms. Two or more compounds can be used as a mixture, if desired.

Specific examples of benzoic acid esters which are preferably used in the present invention are shown below together with the properties thereof, although the present invention is not to be construed as limited thereto. In the Table, A indicates the solubility in water at 25° C (% by weight), B indicates the amount of water which can be dissolved at 25° C (% by weight) and C indicates the boiling point at atmospheric pressure.

Table

| COMPOUND | A | B | C |
|---|---|---|---|
| (1) n-Octyl Benzoate $C_6H_5COOC_8H_{17}(n)$ | below 0.1 | below 0.1 | above 250° C |
| (2) iso-Nonyl Benzoate $C_6H_5COOC_9H_{19}(iso)$ | " | " | " |
| (3) 2-Ethylhexyl Benzoate $C_6H_5COOCH_2CH(C_2H_5)C_4H_9(n)$ | " | " | " |
| (4) Lauryl Benzoate $C_6H_5COOC_{12}H_{25}(n)$ | " | " | " |
| (5) Oleyl Benzoate $C_6H_5COO(CH_2)_8CH{=}CH(CH_2)_7CH_3$ | " | " | " |
| (6) n-Butyl Benzoyl lactate $C_6H_5COOCH(CH_3)COOC_4H_9(n)$ | " | " | " |
| (7) n-Hexyl Benzoyl lactate $C_6H_5COOCH(CH_3)COOC_6H_{13}(n)$ | " | " | " |
| (8) n-Decyl Benzoyl lactate $C_6H_5COOCH(CH_3)COOC_{10}H_{21}(n)$ | " | " | " |

The high boiling point solvent of the present invention is characterized in that it is substantially harmless and hardly causes environmental pollution. Further, the benzoic acid ester according to the present invention is superior to a phthalic acid ester such as dibutyl phthalate, etc., and a phosphoric acid ester such as tricresyl phosphate, etc., with respect to its dispersion capability and color image stability. This will be understood from the Examples described hereinafter.

As a photographic additive which can be dispersed in a hydrophilic organic colloid using the high boiling point benzoic acid ester solvent according to the present invention, all of compounds which have been dispersed in the hydrophilic colloids using conventional high boiling point solvents can be advantageously employed.

Representative additives are a coupler which is capable of undergoing a coupling reaction with the oxidation product of an aromatic primary amine color developing agent, an antioxidant capable of preventing color fog due to the oxidation product of an aromatic primary amine color developing agent and oxidation of the color image formed, a fading preventing agent, for example, an alkylhydroquinone, an alkylphenol, a chroman, a cumarone, etc., a hardening agent, a compound selectively absorbing visible light or ultraviolet light such as an oil-soluble filter dye or an oil-soluble ultraviolet absorbing agent, a fluorescent brightening agent, a DIR compound, for example, a DIR coupling compound, etc., a developing agent, a DDR coupler, a DDR redox compound, a dye developing agent, and the like.

Couplers used in the present invention include a compound which is capable of forming a dye upon color development using an aromatic primary amine developing agent, for example, a phenylenediamine derivative, an aminophenol derivative, etc. For instance, examples of such couplers are a 5-pyrazolone coupler, a pyrazolobenzimidazole coupler, a cyanoacetyl cumarone coupler, an open chain acylacetonitrile coupler, an acylacetamide coupler such as a benzoyl acetanilide and a pivaloyl acetanilide, a naphthol coupler, a phenol coupler, and the like.

In greater detail, as a magenta coupler, a 5-pyrazolone coupler, a cyanoacetyl cumarone coupler, an indazolone coupler, a pyrazolobenzimidazole coupler, and the like can be used. The couplers represented by the following general formula (II) are particularly useful:

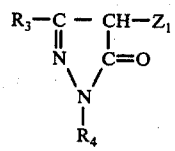

(II)

wherein $R_3$ represents an unsubstituted or substituted alkyl group selected from a primary, secondary or tertiary alkyl group (such as methyl, propyl, n-butyl, t-butyl, hexyl, 2-hydroxyethyl, 2-phenylethyl and the like); an aryl group; a heterocyclic group (such as quinolyl, pyridyl, benzofuranyl, oxazolyl, and the like); an amino group (such as methylamino, diethylamino, cyclobutylamino, phenylamino, tolylamino, 4-(3-sulfobenzamino)anilino, 2-chloro-5-acylamino-anilino, 2-chloro-5-alkoxycarbonylanilino, 2-trifluoromethylphenylamino, heterocyclic amino and the like); a carbonamido group (such as alkylcarbonamido such as ethylcarbonamido, arylcarbonamido, heterocyclic carbonamido such as benzothiazolylcarbonamido and the like); a sulfonamido group (such as alkylsulfonamido, arylsulfonamido, heterocyclic sulfonamido and the like) or an ureido group (such as alkylureido, arylureido, heterocyclic ureido and the like); $R_4$ represents an aryl group (such as naphthyl, phenyl, 2,4,6-tri-chlorophenyl, 2-chloro-4,6-dimethylphenyl, 2,6-dichloro-4-methoxyphenyl, 4-methylphenyl, 4-acylaminophenyl, 4-alkylaminophenyl, 4-aryloxyphenyl, 4-trichloromethyl phenyl, 3,5-dibromophenyl, and the like); or a heterocyclic group (such as benzofuranyl, naphthooxazolyl, quinolyl, and the like); and $Z_1$ represents a hydrogen atom or a group which is releasable upon color development. Examples of the releasable groups are acyloxy, aryloxy, halogen, thiocyano, disubstituted amino, aryloxycarbonyloxy, alkoxycarbonyloxy, benzodiazolyl, indazolyl, acylamino, sulfonamido, arylazo, heterocyclic azo, and the like. These compounds are described, for example, in U.S. Pat. Nos. 3,227,550; 3,252,924; 3,311,476, and 3,419,391; German Patent Application (Laid Open) No. 2,015,867; and Japanese Patent Applications Nos. 45971/1973, 21454/1973, 25845/1972, 33238/1973, 34828/1973, 35378/1973, 41869/1973, 54456/1973, 56050/1973, 27911/1974 and 66378/1974.

Further, a group capable of releasing a development inhibitor upon development, for example, an arylmonothio group (such as 2-amino-phenylthio group, 2-nitrophenylthio group, 4-nitrophenylthio group, 2-carboxyphenylthio group, and the like), a heterocyclic monothio group (such as tetrazolylthio, triazinylthio, triazolylthio, oxazolylthio, oxadiazolylthio, diazolylthio, thiazylthio, a thiadiazolylthio, and the like), a 2-aminophenylazo group, a 2-aminophenylazoxy group, a 2-acylaminophenylazo group, a 2-acylaminophenylazoxy group, a heterocyclic imino group (such as 1-benzotriazolyl, 1-indazolyl, 2-benzotriazolyl, and the like) can be used for $Z_1$. These compounds are described, for example, in U.S. Pat. Nos. 3,148,062; 3,227,554; 3,615,506 and 3,701,783.

Examples of yellow couplers include an open chain acylacetamido coupler (such as a pivaloyl acetanilide coupler, a benzoyl acetanilide coupler, and the like), an open chain acylacetonitrile coupler, and the like. The couplers represented by the following general formula (III) are particularly useful.

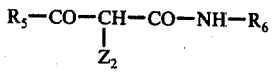

(III)

wherein $R_5$ represents a primary alkyl group, a secondary alkyl group or a tertiary alkyl group, each of which can have 1 to 18 carbon atoms (such as t-butyl, 1,1-dimethylpropyl, 1,1-dimethyl-1-methoxyphenoxymethyl and the like); an aryl group (such as phenyl, alkylphenyl, e.g., 3-methylphenyl, 3-octadecylphenyl, alkoxyphenyl, e.g., 2-methoxyphenyl, 4-methoxyphenyl, halophenyl, 2-halo-5-alkamidophenyl, e.g., 2-chloro-5-[α-(2,4-di-tert-amylphenoxy)butylamido]phenyl and 2-methoxy-5-alkylamidophenyl, where the alkylamido moiety is, for example, acetylamido, 2-chloro-5-sulfonamidophenyl, and the like); or a heterocyclic group; $R_6$ represents an aryl group (such as 2-chlorophenyl, 2-halo-5-alkamidophenyl, e.g., 2-chloro-5-[α-(2,4-di-tert-amylphenoxy)-acetamido]phenyl, 2-chloro-5-(4-methylphenylsulfonamido)phenyl, 2-methoxy-5-(2,4-di-tert-amylphenoxy)acetamidophenyl, and the like), or an aromatic heterocyclic group; $Z_2$ represents a hydrogen atom or a group which is releasable upon color development. Examples of the releasable group are a halogen atom (particularly a fluorine atom), or an acyloxy, alkoxy, aryloxy, aromatic heterocyclic carbonyl, aromatic heterocyclic oxy, sulfimido, sulfoamido, alkylsulfoxy, arylsulfoxy, phthalimido, acylamino, dioxoimidazolidinyl, dioxooxazolidinyl, indazolyl, hydantoinyl, dioxothiazolidinyl, azo and like groups. These compounds are described, for example, in U.S. Pat. Nos. 3,227,550; 3,253,924; 3,277,155; 3,265,506; 3,408,194 and 3,415,652; French Pat. No. 1,411,384; British Pat. Nos. 944,490; 1,040,710 and 1,118,028; and German Patent Applications (Laid Open) Nos. 2,057,941; 2,163,812; 2,213,461 and 2,219,971.

Further, a group capable of releasing a development inhibitor upon development, for example, an arylmonothio group (such as a phenylthio group, 2-carboxyphenylthio group, and the like); a heterocyclic thio group (such as a 1-phenyl-5-tetrazolylthio group, 2-benzoxazolylthio group and the like), a 1-benzotriazolyl group, a 2-benzotriazolyl group, a benzodiazolyl group, an o-aminophenylazo group, an o-aminophenylazoxy group, an o-acylamino-phenylazo group, an o-acylaminophenylazoxy group, an alkylthio group, and the like can be used for $Z_2$.

Examples of cyan couplers are a naphthol coupler, a phenol coupler and the like. The couplers represented by following general formulae (IV) and (V) are particularly useful.

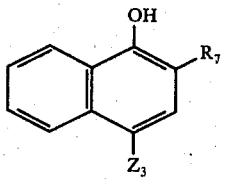

(IV)

-continued (V)

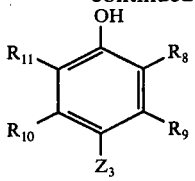

wherein $R_7$ represents a substituent as typically used in a cyan coupler, for example, a carbamoyl group (such as alkylcarbamoyl, arylcarbamoyl, e.g., phenylcarbamoyl, etc., heterocyclic carbamoyl, e.g., benzothiazolyl carbamoyl, etc., and the like); a sulfamoyl group (such as alkylsulfamoyl, arylsulfamoyl, e.g., phenylsulfamoyl, etc., heterocyclic sulfamoyl, and the like); an alkoxycarbonyl group; an aryloxycarbonyl group; and the like, $R_8$ represents an alkyl group; an aryl group; a heterocyclic group; an amino group (such as amino, alkylamino, arylaminoheterocyclic amino, and the like); a carbonamido group (such as alkylcarbonamido, arylcarbonamido and the like); a sulfonamido group; a sulfamyl group (such as alkylsulfamyl arylsulfamyl, heterocyclic sulfamoyl, and the like); a carbamyl group and the like; $R_9$, $R_{10}$, and $R_{11}$ can each be a group as defined for $R_8$ and also a hydrogen atom, a halogen atom or an alkoxy group; and $Z_3$ represents a hydrogen atom or a group which is releasable by coupling with an oxidation product of an aromatic primary amine developing agent. Examples of the releasable group are a halogen atom (such as an iodine atom, fluorine atom, chlorine atom or bromine atom), or an indazolyl, an aromatic heterocyclic carbonyl, sulfoamido, sulfoimido, alkylsulfoxy, arylsulfoxy, sulfinyl, sulfonyl, cyclic imido, acylamino, acyloxy, aryloxy, alkoxy, heterocyclic oxy, sulfo, arylazo, heterocyclic azo, and like groups. These compounds are described, for example, in U.S. Pat. Nos. 2,423,730; 3,227,550 and 3,311,476; and British Pat. Nos. 1,084,480 and 1,165,563; etc. Colored couplers as are described in U.S. Pat. Nos. 2,983,608; 3,005,712 and 3,034,892; British Pat. Nos. 936,621; 1,269,073; 586,211 and 627,814; and French Pat. Nos. 980,372; 1,091,903; 1,257,887; 1,398,308 and 2,015,649; etc., can also be used. Further, as a group capable of releasing a development inhibitor upon development, the groups defined for $Z_2$ can also be used.

The couplers used in the present invention are preferably diffusion-resistant. To render the coupler diffusion-resistant a group containing a hydrophobic residue of about 8 to 32 carbon atoms is introduced in the coupler molecule. These residues are called ballast groups. The ballast group can be connected to the coupler nucleus directly or through an imino bond, an ether bond, a carbonamido bond, a sulfonamido bond, an ureido bond, an ester bond, an imido bond, a carbamoyl bond, a sulfamoyl bond, or the like.

Representative examples of ballast groups are shown in the specific examples of the couplers which can be used in the present invention given hereinafter.

The following are also representative examples of ballast groups.

(I) Alkyl and alkenyl groups e.g., $-CH_2-CH(C_2H_5)_2$, $-C_{12}H_{25}$, $-C_{16}H_{33}$, $-C_{17}H_{33}$, etc, (II) Alkoxyalkyl groups (I) Alkyl and alkenyl groups
e.g., $-CH_2-CH(C_2H_5)_2$, $-C_{12}H_{25}$, $-C_{16}H_{33}$, $-C_{17}H_{33}$, etc, (II) Alkoxyalkyl groups
e.g., $-(CH_2)_3-O-(CH_2)_7CH_3$, $-(CH_2)_3OCH_2-\underset{\underset{C_2H_5}{|}}{CH}-(CH_2)_8-CH_3$, etc.

as described in Japanese Patent Publication 27563/1964.

(III) Alkylaryl groups

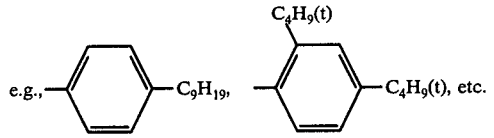

(IV) Alkylaryloxyalkyl groups

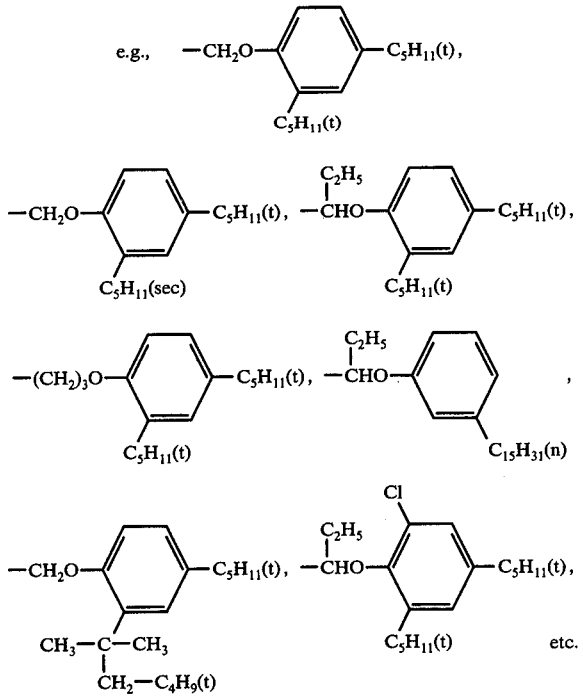

(V) Acylamidoalkyl groups

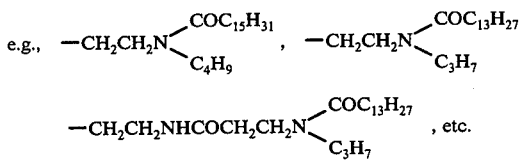

as described in U.S. Pat. Nos. 3,333,344 and 3,418,129.

(VI) Alkoxyaryl and aryloxyaryl groups

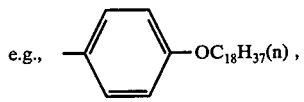

-continued

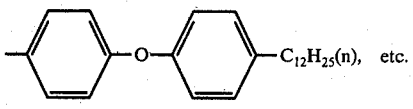

(VII) Groups containing long chain aliphatic groups such as an alkyl or alkenyl group and groups such as a carboxy or sulfo group which are water-solubilizing groups e.g., $-\underset{\underset{CH_2COOH}{|}}{CH}-CH=CH-C_{16}H_{33}$, $-\underset{\underset{SO_3H}{|}}{CH}-C_{16}H_{33}$, etc.

(VIII) Ester substituted alkyl groups e.g., $-\underset{\underset{COOC_2H_5}{|}}{CH}-C_{16}H_{33}(n)$, $-CH_2-CH_2-COOC_{12}H_{25}(n)$, etc.

(IX) Aryl or heterocyclic group substituted alkyl groups e.g., $-CH_2-CH_2-$ 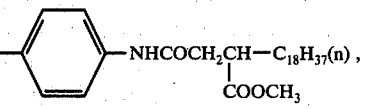 $-NHCOCH_2\underset{\underset{COOCH_3}{|}}{CH}-C_{18}H_{37}(n)$,

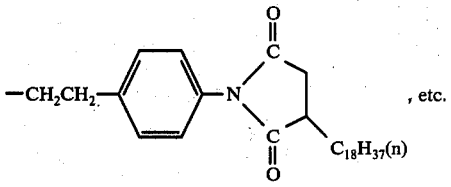

, etc.

(X) Aryloxyalkoxycarbonyl substituted aryl groups e.g., e.g., 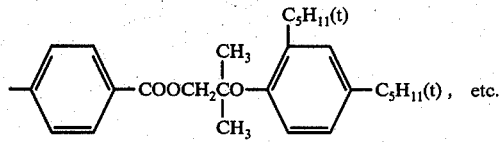

Specific examples of couplers which can be used in the present invention are set forth in the following, although the present invention is not to be construed as limited thereto.

Yellow Couplers (I) α-{3-[α-(2,4-Di-tert-amylphenoxy)butyramido]-benzoyl}-2-methoxyacetanilide
(2) α-Acetoxy-α-3-[γ-(2,4-di-tert-amylphenoxy)-butyramido]-benzoyl-2-methoxyacetanilide
(3) N-(4-Anisoylacetamidobenzenesulfonyl)-N-benzyl-N-toluidine
(4) α-(2,4-Dioxo-5,5-dimethyloxazolyzinyl)-α-pivaloyl-2-chloro-5-[α-(2,4-di-tert-amylphenoxy)-butyramido]acetanilide
(5) α-(4-Carboxyphenoxy)-α-pivaloyl-2-chloro-5-[α-(2,4-di-tert-amylphenoxy)butyramido]acetanilide
(6) α-[3-(1-Benzyl-2,4-dioxo)hydantoinyl]-α-pivaloyl-2-chloro-5-[α-2,4-di-tert-amylphenoxy)-butyramido]acetanilide
(7) α-Benzoyl-α-(2-benzothiazolylthio)-4-[N-(γ-phenylpropyl)-N-(4-tolyl)sulfamyl]acetanilide
(8) α-Pivaloyl-α-(5- or 6-bromo-1-benzotriazolyl-5-[α-(2,4-di-tert-amylphenoxy)propionamido]-2-chloroacetanilide Magenta Couplers (9) 1-(2,4,6-Trichlorophenyl)-3-[3-(2,4-di-tert-amylphenoxy-acetamido)benzamido]-5-pyrazolone
(10) 1-(2,4,6-Trichlorophenyl)-3-{3-[α-(2,4-di-tert-amylphenoxy)acetamido]benzamido}-4-acetoxy-5-pyrazolone
(11) 1-(2,4,6-Trichlorophenyl-3-tridecylamido-4-(4-hydroxyphenyl)-azo-5-pyrazolone
(12) 1-(2,4,6-Trichlorophenyl)-3-[(5-tridecanoylamino-2-chloro)anilino]-5-pyrazolone
(13) 1-(2,4,6-Trichlorophenyl)-3-(5-tetradecyloxycarbonyl-2-chloro)anilino-4-(1-naphthylazo)-5-pyrazolone
(14) 1-(2,4-Dichloro-6-methoxyphenyl)-3-[(5-tridecanoylamino-2-chloro)anilino]-4-benzyloxycarbonyloxy-5-pyrazolone
(15) 1-{4-[γ-(2,4-Di-tert-amylphenoxy)butyramido]-phenyl}-3-piperidinyl-4-(1-phenyl-5-tetrazolylthio)-5-pyrazolone
(16) 1-(2,4,6-Trichlorophenyl)-3-{4-[α-2,4-di-tert-amylphenoxy)butyramido]anilino}-4-(1-phenyl-5-tetrazolylthio)-5-pyrazolone
(17) 1-{4-[α-(2,4-Di-tert-amylphenoxy)acetamido]-phenyl}-3-methyl-4-(5- or 6-bromo-1-benztriazolyl)-5-pyrazolone Cyan Couplers

(18) 1-Hydroxy-N-[γ-(2,4-di-tert-amylphenoxy)-propyl]-2-naphthamide
(19) 1-Hydroxy-4-[2-(2-hexyldecyloxycarbonyl)-phenylazo]-2-[N-(1-naphthyl)]naphthamide
(20) 1-Hydroxy-4-chloro-N-[α-(2,4-di-tert-amylphenoxy)-butyl]-2-naphthamide
(21) 5-Methyl-4,6-dichloro-2-[α-(3-n-pentadecylphenoxy)-butyramido]phenol
(22) 1-Hydroxy-4-iodo-N-dodecyl-2-naphthamide
(23) 5-Methoxy-2-[α-(3-n-pentadecylphenoxy)-butyramido]-4-(1-phenyl-5-tetrazolylthio)phenol Non-color Forming Couplers

(24) N-[α-(2,4-Di-tert-amylphenoxy)acetyl]-ω-(1-phenyl-5-tetrazolylthio)-m-aminoacetophenone Photographic additives suitable for use in a diffusion transfer photographic material which can be used in the present invention include, for example, a diffusible dye releasing type redox compound (DDR redox compound), a diffusible dye releasing type coupler (DDR coupler), a dye developing agent, an amidrazone compound which releases a diffusible dye upon reaction with an oxidation product of a developing agent, and the like.

In more detail, a diffusible dye releasing type redox compound (DDR redox compound) as described, for example, in Japanese Patent Applications (Laid Open) Nos. 33826/1973, 126331/1974 and 126332/1974; Japanese Patent Applications Nos. 38305/1975 and 39997/1975, etc., a diffusible dye releasing coupler which releases a diffusible dye upon reaction with an oxidation product of a color developing agent (DDR coupler) as described, for example, in British Pat. Nos. 840,731; 904,364 and 1,038,331; U.S. Pat. Nos. 2,756,142; 3,227,550; 3,227,551; 3,227,554 and 3,765,886; U.S. Defensive Publication UST No. 900,029, Japanese Patent Application (Laid Open) No. 123022/1974, Japanese Patent Applications No. 57040/1975 and 84844/1975, etc., an amidrazone compound which releases a diffusible dye upon reaction with an oxidation product of a developing agent as described, for example, in Japanese Patent Publication No. 39165/1973, Japanese Patent Applications (Laid Open) Nos. 2327/1972 and 64436/1974, etc., a dye developing agent as described, for example, in Japanese Patent Applications Nos. 105236/1973; 87792/1971; 125818/1973; 131494/1973; 139418/1973; 115778/1974; 32838/1973 and 706681974, etc., and the like, can be used.

The dye developing agent which can be used in the present invention is a compound which has a dye structure moiety and a group capable of developing silver halide in the same molecule. The light absorption of the dye developing agent is advantageously selected so as to use a subtractive color reproduction, that is, to provide a yellow, magenta or cyan color. The dye structure moiety which provides such absorption is derived from an azo dye, an anthraquinone dye, a phthalocyaning dye, a nitro dye, a quinoline dye, an azomethine dye, an indamine dye, an indoaniline dye, an indophenol dye, an azine dye, and the like. On the other hand, the group capable of developing silver halide is a group capable of developing light-exposed silver halide and is preferably a group which loses hydrophilicity as a result of oxidation. In general, a benzenoid developing agent group, that is, an aromatic developing agent group which forms a quinoid upon being ozidized, is suitable. A preferred developing agent group is a hydroquinonyl group. As other suitable developing agent groups, illustrative examples are an o-dihydroxyphenyl group, an o- or p-amino-substituted hydroxyphenyl group, and the like. In preferred dye developing agents, the dye structure moiety and the developing agent group are separated from each other by a saturated aliphatic group such as an ethylene group, which prevents electronic conjugation. In particular, a 2-hydroquinonylethyl group and a 2-hydroquinonylpropyl group are useful. The dye structure moiety and the developing agent group can be connected to each other through a coordinate bond as described in U.S. Pat. Nos. 3,551,406; 3,563,739; 3,597,200 and 3,674,478, as well as a covalent bond.

Further, for some end-use purposes and in some diffusion transfer color photographic material structures, it is advantageous to reduce the dye structure moiety to thereby temporarily convert the dye structure to the colorless leuco form as is described in U.S. Pat. No. 3,320,063, or to acylate the hydroxyl group or amino group of the auxochrome to thereby temporarily shift the absorption to a shorter wave-length side as described in U.S. Pat. Nos. 3,230,082; 3,307,947 and 3,579,334 and Japanese Patent Application No. 76226/1973.

Further, dye developing agents having a dye structure moiety containing a hydroxy group at the ortho position to the azo group are useful in that they have excellent absorption characteristic and color image stability as is described in U.S. Pat. No. 3,229,041.

Other dye developing agents suitable for use in diffusion transfer color photography according to this invention are described in U.S. Pat. Nos. 2,983,605; 2,992,106; 3,047,386; 3,076,808; 3,076,820; 3,077,402; 3,126,280; 3,131,061; 3,134,762; 3,134,765; 3,135,604; 3,136,605; 3,135,606; 3,135,734; 3,141,772; 3,142,565; 3,173,906; 3,183,909; 3,246,985; 3,230,086; 3,309,199; 3,230,083; 3,239,339; 3,347,672; 3,347,673; 3,245,790; 3,230,082; etc.

Antioxidants which can be used in the present invention include a phenol or hydroquinone derivative or a precursor thereof having an aliphatic group of 8 or more carbon atoms such as those compounds described, for example, in U.S. Pat. Nos. 2,336,327; 2,728,659 and 2,835,579 and in Japanese Patent Application (Laid Open) No. 2128/1971.

Further, the compounds described in German Pat. No. 1,547,684, German Patent Application (Laid Open) No. 2,146,668 and Belgian Pat. No. 777,487 are particularly suitable as an antioxidant for color images in this invention.

Filter dyes which can be used in the present invention include an oleophilic oxonol dye, a benzotriazole ultraviolet absorbing agent and a benzophenone ultraviolet absorbing agent such as those compounds described, for example, in Japanese Patent Publications Nos. 21687/1967 and 5496/1973; Japanese Patent Applications (Laid Open) Nos. 1026/1972 and 2784/1971 and British Pat. No. 1,293,982, etc.

In particular, the compounds represented by the following general formulae (VI), (VII) and (VIII) are preferred.

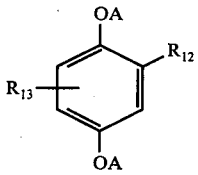

General Formula (VI)

wherein $R_{12}$ represents a straight or branched chain alkyl group containing 8 to 20 carbon atoms; $R_{13}$ represents a hydrogen atom, a straight or branched chain alkyl group containing 8 to 20 carbon atoms or an alkylthio group; and A represents an hydrogen atom or a group which is hydrolyzed under alkaline conditions, preferably such as esters, more preferably an acetyl group, an alkoxycarbonyl group, etc. The benzene nucleus can be further substituted with an alkyl group containing 8 or less carbon atoms, a halogen atom, and the like.

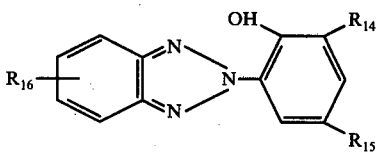

General Formula (VII)

wherein $R_{14}$ and $R_{15}$ each represents a hydrogen atom or an alkyl group containing 5 or less carbon atoms; and $R_{16}$ represents a hydrogen atom, an alkoxy group or a halogen atom.

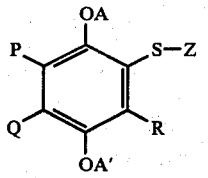

General Formula (VIII)

wherein P, Q and R each represents a hydrogen atom, a straight or branched chain alkyl group containing 1 to 20 carbon atoms (such as methyl, allyl, ethyl, octyl, tridecyl, and the like), an alkenyl group containing 1 to 20 carbon atoms (such as allyl, and the like), a hydroxy group, an alkoxy group (such as methoxy, ethoxy, and the like), an amino group, an alkylthio group (such as nonylthio, tridecylthio, and the like), an arylthio group, an aryl group (such as phenyl, tolyl, and the like), a halogen atom, a heterocyclic group (such as tetrazolyl, thiazolyl, quinolyl, and the like), or an —S—Z residue where Z is as later defined (such as tetrazolylthio, thiadiazolylthio, and the like); P and Q can combine to form a carbon containing ring, most preferably a 5 to 7 carbon atom ring; A and A' each represents a hydrogen atom or a group which is hydrolyzed under alkaline conditions, preferably such as esters, more preferably an acetyl group, an alkoxycarbonyl group, etc.; and Z represents a heterocyclic group which is substantially photographically inert and is removable upon development, particularly an aromatic heterocyclic ring, for example, a tetrazolyl group (such as 1-phenyltetrazolyl, 1-alkoxyphenyltetrazolyl, and the like), a triazolyl group (such as 1-phenyl-3-n-amyl-1,2,4-triazolyl and the like), a thiadiazolyl group (such as 5-methylthiothadiazolyl, 5-propylthiadiazolyl, and the like), an oxazolyl group (such as 4-methyloxazolyl, benzoxazolyl, α-naphthoxazolyl, and the like), an oxadiazolyl group, a thiazolyl group, a pyrimidyl group, or the like.

The high boiling point benzoic acid ester solvents of the present invention can be used in combination with a substantially water insoluble low boiling point auxiliary solvent (preferably such a solvent having a boiling point not more than 200° C, even more preferably not more than 150° C., such as methyl acetate, ethyl acetate, butyl acetate, and the like) or a water-soluble organic auxiliary solvent (such as methyl isobutyl ketone, β-ethoxy ethyl acetate, methyl carbitol, methyl cellusolve, dipropylene glycol, dimethyl formamide dioxane or the like). These low boiling point auxiliary solvents are described, for example, in U.S. Pat. Nos. 2,801,170; 2,801,171; 2,949,360 and 2,835,579. These auxiliary solvents can be removed by washing as described in U.S. Pat. Nos. 2,801,171; 2,949,360 and 3,396,027 or can be removed by evaporation as described in U.S. Pat. Nos. 2,322,027 and 2,801,171 and German Patent Application (Laid Open) No. 2,045,464.

The photographic additives such as couplers, antioxidants, filter dyes, and the like can, individually or as a mixture of two or more, be dissolved in the high boiling point benzoic acid ester solvent of the present invention and the solution dispersed in an aqueous solution of a hydrophilic colloid, particularly gelatin. In such a case, the use of one or more of the high boiling point benzoic acid ester solvents in combination with an auxiliary solvent is particularly preferred. Useful dispersion procedures are described, for example, in U.S. Pat. Nos. 2,304,939; 2,322,027; 2,801,170; 2,801,171 and 2,949,360.

As an auxiliary dispersion agent, an anionic surface active agent (such as sodium alkylbenzene sulfonate, sodium dioctylsulfosuccinate, sodium dodecyl sulfate, sodium alkylnapthalene sulfonate, and the like), an amphoteric surface active agent (such as N-tetradecyl-N,N-dipolyethylene-α-betaine, and the like), and a nonionic surface active agent (such as sorbitan monolaurate, and the like) can be used.

Of these compounds, an alkylbenzene sulfonate type or alkylnaphthalene sulfonate type anionic surface active agent and an anionic surface active agent represented by the following general formulae (IX) and (X) are advantageously used as the auxiliary dispersion agent.

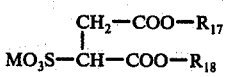

General Formula (IX)

wherein $R_{17}$ and $R_{18}$ each represents a straight or branched chain alkyl group containing 4 to 20 carbon atoms, and M represents a cation (such as sodium ion, potassium ion, ammonium ion, and the like).

Usually, the auxiliary solvents are used in a proportion of 0 to 10 times by (volume) the volume of the high boiling point benzoic acid ester solvent, more preferably, 1 to 6 volume times, and auxiliary dispersion agents are generally used in an amount of from 1 to 50 wt.% of the coupler, preferably 2 to 20 wt.% of the coupler.

The compounds represented by the general formula (IX) disperse a solution (oil droplet) and stabilize the colloid to the same extent as or greater than with conventionally used Alkanol B or alkylbenzene sulfonates. Moreover, they do not have any harmful effect on the human body.

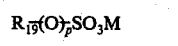

General Formula (X)

wherein $R_{19}$ represents an aliphatic group including a straight or branched chain alkyl group containing 4 to 20 carbon atoms (such as octyl, decyl, dodecyl, octadecyl, 5-methylhexyl,

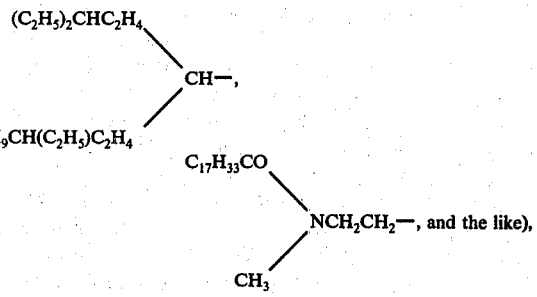

*p* represents 0 or 1; and M has the same meaning as defined for M in general formula (IX).

The hydrophilic organic colloid layer according to the present invention is a photographic layer containing a conventional hydrophilic organic colloid as a binder. Examples of the hydrophilic organic colloids are gelatin which is most commonly used, a cellulose derivative such as methylcellulose, acetylcellulose, hydroxyethylcellulose, etc., sodium alginate, a hydrophilic synthetic polymer (such as polyvinyl alcohol, polyvinyl pyrrolidone, polystyrene sulfonic acid, a copolymer of styrene sulfonic acid, a copolymer of maleic acid, a copolymer of acrylic acid, a copolymer of methacrylic acid, a copolymer of itaconic acid, and the like, a modified gelatin (such as phthalated gelatin, and the like), and the like. The above described hydrophilic organic colloids other than gelatin can be used individually or as a mixture of two or more of such colloids, but they are conventionally used together with gelatin, where the gelatin is preferably not less than about 25 wt.% of the total colloids used. The hydrophilic organic colloid layer can optionally contain a polymer latex (such as polymethyl methacrylate latex, polyethyl acrylate latex, and the like) to improve the physical properties of the photographic layer.

The hydrophilic organic colloid layers include silver halide photographic light-sensitive layers and non-light-sensitive photographic auxiliary layers (such as a protective layer, an intermediate layer, a filter layer, an irradiation preventing layer, an antihalation layer, a backing layer, a development contamination preventing layer, a barrier layer, and the like).

The silver halide emulsions which can be used in the present invention are photographic emulsions comprising silver halide such as silver bromide, a silver iodide, silver chloride or mixtures thereof, e.g., silver chlorobromide, silver iodobromide, and silver chloroiodobromide. When at least one layer of the photographic emulsion layers contains silver chloroiodide, silver iodobromide or silver chloroiodobromide with an iodide content of about 1 to 10 mol%, good results can be obtained.

Conventionally used chemical sensitizing procedures can be applied to the silver halide emulsion as used in the present invention, if desired. For instance, gold sensitization as described in U.S. Pat. Nos. 2,399,083; 2,597,856; and 2,597,915; reduction sensitization as described in U.S. Pat. Nos. 2,487,850 and 2,521,925; sulfur sensitization as described in U.S. Pat. Nos. 1,623,499 and 2,410,689; sensitization using different metal ions as described in U.S. Pat. Nos. 2,448,060; 2,566,245 and 2,566,263, and combinations of the above mentioned processes can be employed. If desired the silver halide photographic emulsion which can be used in the present invention can be spectrally sensitized with a sensitizing dye which as is conventionally used for the spectral sensitization of a color photographic light-sensitive material together with a conventional coupler, such as anhydro-9-methyl-5,5'-dimethyl-3,3'-di(3-sulfopropyl)-benzoselenacarbocyanine, 5,5'-dichloro-9-ethyl-di(2-hydroxyethyl)thiacarbocyanine bromide, anhydro-5,5'-diphenyl-9-ethyl-3,3'-di(2-sulfoethyl)benzoxazolocarbocyanine hydroxide, and the like.

The silver halide emulsions used in the present invention can contain a conventionally used stabilizer such as a 4-hydroxyl-1,3,3a,7-tetraazaindene derivative and the like; an antifogging agent such as a mercapto compound a benzotriazole derivative, and the like; a coating aid such as saponin, sodium alkylbenzene sulfonate, and the like; a hardening agent such as formaldehyde, mucobromic acid, 2,4-dichloro-6-hydroxy-s-triazine sodium salt and the like; a wetting agent; a sensitizing agent such as an onium derivative, e.g., the tertiary ammonium salts as described in U.S. Pat. Nos. 2,271,623; 2,288,226; and 2,334,864 and a polyalkylene oxide derivative as described in U.S. Pat. Nos. 2,708,162; 2,531,832, 2,533,990; 3,210,191 and 3,158,484; an irradiation preventing dye; and the like.

Furthermore, the color photographic light-sensitive material according to the present invention can contain, as a layer, an intermediate layer to prevent color mixing, a filter layer, a mordant dyed layer, a colored layer containing a hydrophobic dye, etc., in addition to the light-sensitive emulsion layer.

The light-sensitive emulsion used in the present invention can be coated on various kinds of supports. For example, conventional photographic supports such as a cellulose acetate film, a polyethylene terephthalate film, a polyethylene film, a polypropylene film, a glass plate, baryta paper, a resin laminated paper, a synthetic paper, etc. can be used.

For the photographic light-sensitive material of the present invention, a developer solution which can reduce silver halide particle to silver can be used in a processing step for forming color images. In the case of a black and white development, a developer solution containing, as a developing agent, a polyhydroxy benzene, an N-alkylaminophenol, a 1-phenyl-3-pyrazolidone, or a mixture thereof can be used. Examples of commonly used polyhydroxy benzenes include hydroquinone, pyrocatechol, pyrogallol, and the like. Examples of N-alkyl-aminophenols include N-methyl-aminophenol, N-ethylaminophenol and the like. Examples of 1-phenyl-3-pyrazolidones include 1-phenyl-3-pyrazolidone, 1-phenyl-4,4-dimethyl-3-pyrazolidone and the like. In the case of a color development, a developer solution containing, as a developing agent, a conventional para-phenylenediamine derivative such as 4-amino-N,N-diethylaniline, 4-amino-3-methyl-N-methyl-N-($\beta$-methylsulfonamidoethyl)aniline, 4-amino-3-methyl-N-ethyl-N-($\beta$-hydroxyethyl)aniline, 4-hydroxyaniline, 4-hydroxy-2,6-dibromoaniline and the like, can be used.

The photographic light-sensitive material of the present invention can be processed at conventional processing temperatures, e.g., 20° to 30° C, and it is also possible to process the photographic material at a higher temperature, e.g., about 30° to 60° C or high.

Preferred procedures for processing the color light-sensitive material according to the present invention are described, for example, in Japanese Patent Publication No. 35748/1070, Japanese Patent Applications Nos. 67798/1969, 13313/1971 and 19516/1971; H. Gordon *The British Journal of Photography,* page 558 (Nov. 15, 1954), ibid, page 440 (Sept. 9, 1955), ibid, page 2 (Jan. 6, 1956); S. Horowits *The British Journal of Photography,* page 212 (April 22, 1960); E. Gehret *The British Journal of Photography,* page 122 (Mar. 4, 1960); ibid, page 396 (May 7, 1965), J. Meech *The British Journal of Photography,* page 182 (Apr. 3, 1959); German Patent Application (Laid Open) No. 2,238,051, etc.

Various techniques for removing or reducing the causes of environmental pollution are advisably used during the processing procedure.

First, benzyl alcohol (development accelerator) which is usually contained in a color developer solution causes the biological oxygen demand (BOD) to be increased. When the high boiling point benzoic acid ester solvent according to the present invention is used, particularly in combination with a coupler having a hydroxy group or a carboxy group on its ballast group or coupling releasable group (for example, $Z_1$, $Z_2$ or $Z_3$ of general formula (IV), (V) or (VI) described above), a sufficiently rapid development proceeding rate can be obtained and an excellent color image can be obtained by development without benzyl alcohol.

Secondly, ferricyanides or ferrocyanides, which are contained in a bleaching solution for reduced silver, cause harmful cyanide ions to be produced, and while a chelating agent for oxidizable metal salts can be used, such renders the treatment of waste water difficult. In a color photographic light-sensitive material wherein the high boiling point benzoic acid ester solvent according to the present invention is used, the silver image obtained and reduced silver can be easily bleached. Accordingly, the color photographic light-sensitive material can provide advantageous conditions in view of preventing pollution due to bleaching solutions.

The color photographic light-sensitive material of the present invention can be silver-bleached with a bleaching solution having an oxidation-reduction potential (E redox as defined hereinafter) of −150 mV to 1000 mV, containing halide ion and containing a metal salt or an organic oxidizing agent. Examples of the metal salts are transition metal salts, particularly salts or complex salts of $Ti^{4+}$, $V^{5+}$, $Cr^{6+}$, $Mn^{7+}$, $Mn^{3+}$, $Cu^{2+}$, $Fe^{3+}$, $Co^{3+}$, and the like. Examples of the organic oxidizing agents are p-sulfophenylquinone, sulfonaphthoquinone, Bluestar Blue radical, Weitz radicals and the like. These compounds are described, for example, in U.S. Pat. Nos. 2,507,183; 2,529,981; 2,625,477; 2,748,000; 2,810,648; and 2,705,201; British Pat. Nos. 1,111,313; 777,635; 1,032,024, 1,014,396 and 982,984; and Japanese Pat. Nos. 14035/1970 and 13944/1966, etc.

E redox as used in the present specification is defined as the value determined in the following manner.

Measurement was carried out using a conjugated platinum electrode (EA-216; manufactured by Metrohm, Ltd.) equipped with a silver/silver chloride electrode as a reference electrode and a potentiometer (E-436; manufactured by Metrohm, Ltd.) at 25° C±0.2° C. Examples of measurements are shown below.

Blixing solution used in Example 3 described hereinafter pH = 6.8 E redox = -30mV

| Bleaching Solution | |
|---|---|
| Potassium Bromide | 20 g |
| Ferric Chloride (hexahydrate) | 41.5 g |
| Water to make | 1 liter |
| pH = 1.5 E redox = 720 mV | |

Color photographic light-sensitive materials to which the present invention can be applied include color negative films, color positive films, color reversal films, color papers and various other kinds of color photographic light-sensitive materials.

The present invention can also be applied to color photographic light-sensitive materials in which a smaller amount of silver halide is used as is described in German Patent Application (Laid Open) No. 2,357,964, etc. For example, a color photographic light-sensitive material containing a small amount of silver halide includes from several tenths to one hundredth (for example, about 65 to 375 mg/m² of silver halide per layer) as much silver halide as that in a conventional color photographic light-sensitive material for obtaining the same density.

The color photographic light-sensitive materials containing silver halide in such a small amount which can be used in the present invention can be subjected to a processing method in which the developed silver formed by color development is halogenation-bleached and again color developed in order to increase the amount of dye formed, as described, for example, in U.S. Pat. Nos. 2,623,822; 2,814,565; etc., a processing method including color intensification using a peroxide as described in U.S. Pat. Nos. 3,674,490 and 3,761,265, German Patent Application (Laid Open) No. 2,056,360, Japanese Patent Applications (Laid Open) Nos. 6338/1972 and 10538/1972, etc., or using a cobalt complex salt as described in German Patent Application (Laid Open) No. 2,226,770; Japanese Patent Applications (Laid Open) Nos. 9728/1978 and 9729/1973, etc. The present invention is, of course, completely applicable to conventional color photographic light-sensitive materials containing silver halides in conventional amounts, but it finds particular application with the above materials containing silver halide in a reduced amount.

The present invention will be further illustrated by reference to the following examples. However, the present invention is not to be construed as being limited thereto. In the following examples, all percentages were weight percentages, unless otherwise indicated.

EXAMPLE 1

A solution prepared by heating at 60° C a mixture of 10 g of Coupler (21), 5 ml of Compound (3) of the present invention as a high boiling point solvent, 20 ml of ethyl acetate and 2 ml of a 20 wt% methanol solution of sorbitan monolaurate was added to 100 ml of an aqueous solution at 60° C containing 10 g of gelatin, 0.5 g of sodium di-2-ethylhexyl sulfosuccinate and 0.7 g of phenol. The resulting mixture was vigorously mechanically stirred with a homogenizer to prepare coupler Dispersion (I).

The above procedure was repeated except that 10 ml of Compound (7), and for comparison, 10 ml of di-n-butylphthalate and 10 ml of tricresyl phosphate, were used in place of Compound (3) to prepare Dispersion (2), Dispersion (A) and Dispersion (B), respectively.

These dispersions were cooled to about 5° C and stored, and variations in the particle size of the oil droplets and the amount of the coupler precipitated were measured. The results obtained are shown in Table 1.

Table I

| | Stability of Dispersion | | |
|---|---|---|---|
| Dispersion | Particle Size Just After Dispersion* (μ) | Particle Size After Storage at 5° C for 14 Days *(μ) | Amount of Precipitate After Storage at 5° C for 14 Days **(mg) |
| (I) | 0.13 | 0.20 | 3.5 |
| (2) | 0.11 | 0.21 | 4.0 |
| (A) | 0.29 | 0.32 | 15.5 |
| (B) | 0.27 | 0.35 | 10.5 |

Note:
*About 0.3 g of the dispersion involved was added to 100 ml of warm water and the average particle size of the resulting mixture was measured using a light-scattering method.
**10 g of a dispersion was precisely weighed, diluted with warm water three times, and suction filtered using Toyo filter paper No. 5-B (produced by Toyo Roshi Co., Ltd.). The residue on the filter paper was weighed.

The results in Table 1 show that the oil droplets contained in Dispersion (I) and (2) were finer than those contained in Comparison Dispersion (A) or (B). Moreover, the amount of the coupler precipitated during storage was small and a stable dispersion could be obtained.

EXAMPLE 2

The procedure of Example 1 was repeated except that 10 g of Coupler (4) was used in each case in place of Coupler (21) and that 2 ml of Compound (3) and 2 ml of Compound (7) were used, and, for comparison, 2 ml of di-n-butylphthalate and 2 ml of tricresyl phosphate were used as a high boiling point solvent to prepare Dispersion (3), Dispersion (4), Dispersion (C) and Dispersion (D), respectively.

The stability of these dispersions is shown in Table 2, where all measurements were as in Example 1.

Table 2

| Disper- | Particle Size Just After Dispersion (μ) | Particle Size After Storage for 14 Days (μ) | Amount of Precipitate after Storage for 14 Days (mg) |
|---|---|---|---|
| (3) | 0.14 | 0.16 | 2.3 |
| (4) | 0.17 | 0.17 | 1.4 |
| (C) | 0.16 | 0.21 | 11.3 |
| (D) | 0.17 | 0.26 | 12.6 |

These results show that the use of the high boiling point solvent of the present invention provided a dispersion containing fine oil droplets and that the particle size of the droplets changed little during storage. Further, the amount of the coupler precipitated during storage was small and a stable dispersion could be obtained. In summary, the stability of dispersions is markedly improved using the solvent of the present invention as compared with a conventional high boiling point solvent.

EXAMPLE 3

The procedure of Example 1 was repeated except that 10 g of Coupler (12) was used in place of Coupler (21) in each case, and that 2 ml of Compound (3), 2 ml of Compound (7), and, for comparison, 2 ml of di-n-butyl phthalate and 2 ml of tricresyl phosphate were used as a high boiling point solvent to prepare Dispersion (5), Dispersion (6), Dispersion (E) and Dispersion (F), respectively.

36.8 g of Dispersion (5) was mixed with 80 g of a photographic emulsion containing $3.17 \times 10^{-2}$ mol of silver chlorobromide (silver bromide: 95 mol%; silver chloride: 5 mol%) and 6.5 g of gelatin to which 4 ml of a 2% by weight methanol solution of 5-methyl-7-hydroxy-1,3,4,7a-tetraazaindene, 6.4 ml of a 2% by weight aqueous solution of potassium polystyrene sulfonate, 8 ml of a 1% by weight solution of sodium-di-2-ethylhexyl sulfosuccinate and 8 ml of a 2% by weight aqueous solution of 2-hydroxy-4,6-dichloro-s-triazine sodium salt were added. After adjusting the pH to 6.5, the mixture was coated on a cellulose triacetate film in a dry thickness of 6.2 microns to prepare Film (5). Film (5) contained $1.63 \times 10^{-3}$ mol of the coupler and $1.3 \times 10^{-2}$ mol of silver chlorobromide.

The above procedure was repeated using Dispersion (6), (E), and (F) instead of Dispersion (5) to prepare Films (6), (E) and (F), respectively.

These Films were subjected to step-wise exposure and then processed in the following manner using Color Developer Solution (a), containing benzyl alcohol or Color Developer Solution (b), not containing benzyl alcohol.

| (1) Color Processing Steps | | |
|---|---|---|
| 1. Color Development | 30° C | 6 min. |
| 2. Washing | " | 2 " |
| 3. Blixing | " | 1.5 " |
| 4. Washing | " | 2 " |
| 5. Stabilizing | " | 2 " |
| 6. Washing | " | 2 " |
| 7. Drying | | |

The composition of each processing solution was as follows.

| (II) Color Developer Solution(a) | |
|---|---|
| Benzyl Alcohol | 12 ml |
| Diethylene Glycol | 3.5 ml |
| Sodium Hydroxide | 2.0 g |
| Sodium Sulfite (anhydrous salt) | 2.0 g |
| Potassium Bromide | 0.4 g |
| Sodium Chloride | 1.0 g |
| Borax | 4.0 g |
| Sodium Nitrilotriacetate | 1.6 g |
| Hydroxylamine Sulfate | 2.0 g |
| 4-(N-ethyl-N-β-methanesulfonamidoethyl) amino-2-methylaniline Sesquisulfate | 4.3 g |
| Water to make | 1000 ml |

(III) Color Developer Solution (b)

A developer solution prepared by excluding only benzyl alcohol from Color Developer Solution (a).

| (IV) Blixing Solution | |
|---|---|
| Ethylenediamine Tetraacetic Acid Ferric Salt | 40 g |
| Ammonium Thiosulfate (70 wt%) | 150 ml |
| Sodium Sulfite (anhydrous) | 12.0 g |
| Water to make | 1000 ml |
| **(V) Stabilizing Solution** | |
| Sodium Benzoate | 0.5 g |
| Glacial Acetic Acid | 13.0 ml |
| Citric Acid (dihydrate) | 4.2 g |
| Sodium Citrate (dihydrate) | 3.9 g |
| Water to make | 1000 ml |

The photographic properties of the films thus obtained are shown in Table 3.

Table 3

| | Film | | | |
|---|---|---|---|---|
| | (5) | (6) | (E) | (F) |
| Color Developer Solution(a) | | | | |
| Fog | 0.5 | 0.5 | 0.5 | 0.5 |
| Gamma | 3.1 | 3.3 | 3.1 | 3.0 |
| Relative Sensitivity* | 100 | 100 | 100 | 87 |
| Maximum Color Density | 3.09 | 3.21 | 3.08 | 2.91 |
| Color Developer Solution(b) | | | | |
| Fog | 0.6 | 0.4 | 0.6 | 0.7 |
| Gamma | 2.2 | 2.1 | 2.2 | 1.9 |
| Relative Sensitivity* | 80 | 80 | 79 | 56 |
| Maximum Color Density | 2.80 | 2.98 | 2.79 | 2.49 |

Note *The relative sensitivity is the reciprocal of the exposure amount required to provide a density of fog + 1.0.

The results of Table 3 show that high sensitivity and high maximum color density can be obtained without reducing the gradation by using the high boiling point solvent of the present invention. Particularly, in the case of using the color developer solution not containing benzyl alcohol, the reduction of sensitivity and maximum color density was small as compared with the comparison examples.

EXAMPLE 4

In the same manner as described in Example 3 but using 59.2 g of Dispersion (I) used in Example 1 coating in a dry thickness of 3.1 microns, Film (I) was prepared. This film contained $1.63 \times 10^{-3}$ mol of the coupler per square meter of the film.

The same procedure as described above was repeated using Dispersion (A) to prepare Film (A).

These films were exposed and processed in the same manner as in Example 3.

The films so processed were stored in the dark at 60° C and at a relative humidity of 75% for 20 days, and the density thereof then measured. The results obtained are shown in Table 4 as the density reduction ratio (%) relative to the initial density.

Table 4

| COLOR IMAGE STABILITY (Density Reduction Ratio %) | | | | | | |
|---|---|---|---|---|---|---|
| | Color Development | | | | | |
| | Color Developer Solution(a) Initial Density | | | Color Developer Solution(b) Initial Density | | |
| Film | 0.5 | 1.0 | 2.0 | 0.5 | 1.0 | 2.0 |
| (I) | 0 | 3 | 5 | 0 | 1 | 2 |
| (A) | 2 | 7 | 10 | 1 | 2 | 5 |

The results show that the high boiling point solvent of the present invention provides an image of high stability to high temperature and high humidity.

EXAMPLE 5

In the same manner as described in Example 3 but using 89.6 g of Dispersion (4) used in Example 2 and coating in a dry thickness of 3.1 microns, Film (4) was prepared. This film contained $1.63 \times 10^{-3}$ mol of the coupler and $6.5 \times 10^{-3}$ mol of silver chlorobromide per square meter of the film.

The same procedure as described above was repeated using Dispersion (C) to prepare Film (C).

These films were exposed and processed in the same manner as in Example 3.

The films so processed were exposed through an ultraviolet absorbing filter (substantially removing ultraviolet light having a wavelength below 400 mm) to a daylight fluorescent lamp having an illumination intensity of about 100,000 lux at the element surface for 10 days, and the density thereof then measured. The light stability is shown in terms of the density reduction ratio (%) relative to the initial density in Table 5.

Table 5

| | Color Development | | | | | |
|---|---|---|---|---|---|---|
| | Color Developer Solution(a) Initial Density | | | Color Developer Solution(b) Initial Density | | |
| Film | 0.5 | 1.0 | 2.0 | 0.5 | 1.0 | 2.0 |
| (4) | 3 | 10 | 12 | 3 | 7 | 12 |
| (C) | 4 | 12 | 15 | 6 | 9 | 15 |

It can be seen from these results that the high boiling point solvent of the present invention provides an image of high stability to light.

The techniques according to the present invention can be applied to a color negative light-sensitive material, a color reversal light-sensitive material, a color direct positive type light-sensitive material, a transparent color positive light-sensitive material, a color paper light-sensitive material, a light-sensitive material for instant photography based on a diffusion transfer process, a color X-ray light-sensitive material, a monochromatic industrial photographic material, etc. Where a developing agent, an antioxidant and a filter dye are used, the techniques of the present invention are applicable to a black and white light-sensitive material and a light-sensitive material for a diffusion transfer process.

While the present invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material having a hydrophilic organic colloid layer containing a photographic additive dispersed therein using a benzoic acid ester which has a boiling point of higher than 250° C under atmospheric pressure, which has a melting point not more than 100° C, which is soluble in water in a proportion of less than about 10% by weight, and which dissolves water in a proportion of less than about 5% by weight, wherein the benzoic acid ester is selected from the group consisting of the compounds represented by general formula (I)

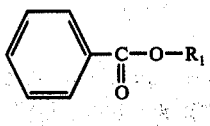

(I)

wherein $R_1$ represents an aliphatic hydrocarbon group having 8 to 24 carbon atoms or a lactic acid ester residue represented by the formula

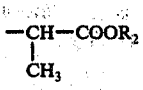

wherein $R_2$ represents an aliphatic hydrocarbon group having 3 to 24 carbon atoms.

2. The photographic material as claimed in claim 1, wherein the aliphatic hydrocarbon group for $R_1$ is an alkyl group, an alkenyl group, an alkyloxalkyl group, a haloalkyl group or a perfluoroalkyl group.

3. The photographic material as claimed in claim 1, wherein $R_1$ is a lactic acid ester residue of the formula

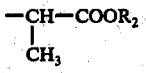

wherein $R_2$ represents an alkyl group, an alkenyl group, an alkyloxyalkyl group, a haloalkyl group or a perfluoroalkyl group.

4. The photographic material as claimed in claim 1, wherein the benzoic acid ester is 2-ethylhexyl benzoate.

5. The photographic material as claimed in claim 1, wherein the benzoic acid ester is n-hexyl benzoyl lactate.

6. The photographic material as claimed in claim 1, wherein two or more of the benzoic acid esters represented by general formula (I) are used.

7. The photographic material as claimed in claim 1, wherein $R_1$ is an alkyl group having 8 to 12 carbon atoms or a lactic acid ester residue of the recited formula wherein $R_2$ represents an aliphatic hydrocarbon group of 3 to 24 carbon atoms.

8. The photographic material as claimed in claim 1, wherein the photographic additive is a coupler.

9. The photographic material as claimed in claim 8, wherein the coupler is a compound represented by general formula (II):

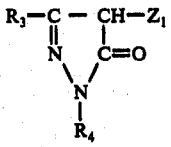

(II)

wherein $R_3$ is an alkyl group, an aryl group, a heterocyclic group, an amino group, a carbonamido group; or a ureido group; $R_4$ is an aryl group, or a heterocyclic group; and $Z_1$ is a hydrogen atom or a group releasable on coupling with the oxidation product of a primary aromatic amine color developing agent.

10. The photographic material as claimed in claim 8, wherein the coupler is a compound represented by general formula (III):

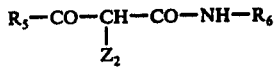

(III)

wherein $R_5$ is an alkyl group, an aryl group or a heterocyclic group; $R_6$ is an aryl group or an aromatic heterocyclic group, and $Z_2$ is a hydrogen atom or a group releasable on coupling with the oxidation product of a primary aromatic amine color developing agent.

11. The photographic material as claimed in claim 8, wherein the coupler is a compound represented by general formula (IV) or (V):

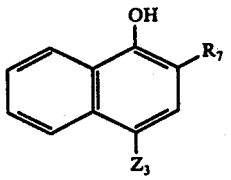

(IV)

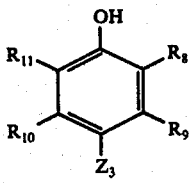

(V)

wherein $R_7$ is a carbamoyl group, a sulfamoyl group, an alkoxy-carbonyl group or an aryloxycarbonyl group; $R_8$ is an alkyl group, an aryl group, a heterocyclic group, an amino group, a carbonamido group, a sulfonamido group, a sulfamyl group or a carbamyl group; $R_9$, $R_{10}$ and $R_{11}$, which may be the same or different, each is the same as $R_8$, a hydrogen atom, a halogen atom or an alkoxy group; and $Z_3$ is a hydrogen atom or a group releasable on coupling with the oxidation product of a primary aromatic amine color developing agent.

12. The photographic material as claimed in claim 1, wherein the photographic additive is a compound represented by general formula (VI):

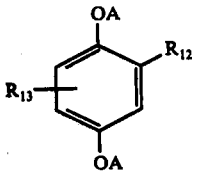

(VI)

wherein $R_{12}$ is an alkyl group; $R_{13}$ is a hydrogen atom, an alkyl group or an alkylthio group; and A is a hydrogen atom or a group removable with alkali.

13. The photographic material as claimed in claim 1, wherein the photographic additive is a compound represented by general formula (VII):

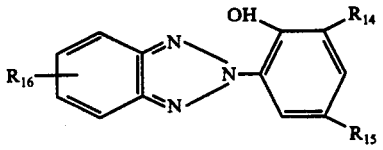

(VII)

wherein $R_{14}$ and $R_{15}$ each is a hydrogen atom or an alkyl group of 5 or less carbon atoms; and $R_{16}$ represents a hydrogen atom, a halogen atom or an alkoxy group.

14. The photographic material as claimed in claim 1, wherein the photographic additive is a compound represented by general formula (VIII):

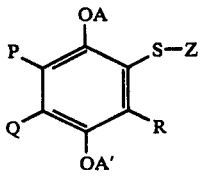

(VIII)

wherein P, Q and R each is a hydrogen atom, an alkyl group, an alkenyl group, a hydroxy group, an alkoxy group, an amino group, an alkylthio group, an arylthio group, an aryl group, a halogen atom, a heterocyclic group or an —S—Z residue; P and Q can combine to form a carbon containing ring; A and A' each is a hydrogen atom or a group removable with alkali; and Z is a heterocyclic group.

15. The photographic material as claimed in claim 1, wherein the benzoic acid ester is in combination with an auxiliary dispersion agent.

16. The photographic material as claimed in claim 15, wherein the auxiliary dispersion agent is a compound of the general formula (IX):

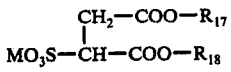

(IX)

wherein $R_{17}$ and $R_{18}$, which may be the same or different, each is a straight or branched chain alkyl group containing 4 to 20 carbon atoms; and M is a cation.

17. The photographic material as claimed in claim 15, wherein the auxiliary dispersion agent is a compound of the general formula (X):

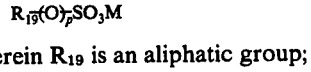

(X)

wherein $R_{19}$ is an aliphatic group; $p$ is 0 or 1; and M is a cation.

* * * * *

UNITED STATES PATENT AND TRADEMARK OFFICE

CERTIFICATE OF CORRECTION

PATENT NO. : 4,080,209

DATED : March 21, 1978

INVENTOR(S) : Yasuo Mukunoki; Takeshi Mikami; Nobuo Tsuji

It is certified that error appears in the above-identified patent and that said Letters Patent are hereby corrected as shown below:

UNDER FOREIGN APPLICATION PRIORITY DATA:

Delete "July 13, 1975" and Insert -- July 3, 1975--.

Signed and Sealed this

*Fourth* Day of *July 1978*

[SEAL]

*Attest:*

RUTH C. MASON
*Attesting Officer*

DONALD W. BANNER
*Commissioner of Patents and Trademarks*